United States Patent [19]

Bürgers

[11] Patent Number: 4,803,815

[45] Date of Patent: Feb. 14, 1989

[54] ENCLOSURE FRAME FOR FACING A WALL OPENING

[75] Inventor: August Bürgers, Erkelenz-Gerderath, Fed. Rep. of Germany

[73] Assignee: Europatent S.A., Luxembourg

[21] Appl. No.: 188,289

[22] Filed: Apr. 29, 1988

[30] Foreign Application Priority Data

May 5, 1987 [DE] Fed. Rep. of Germany ... 8706403[U]

[51] Int. Cl.[4] ..... E06B 1/04

[52] U.S. Cl. ..... 52/210; 52/211

[58] Field of Search ..... 52/210, 211, 212, 204, 52/220, 221

[56] References Cited

U.S. PATENT DOCUMENTS

| | | | |
|---|---|---|---|
| 2,939,188 | 6/1960 | Wahlfeld | 52/211 |
| 3,271,902 | 9/1966 | Dunsmoor | 52/204 |
| 4,505,080 | 3/1985 | Sailor | 52/211 |

*Primary Examiner*—John E. Murtagh

*Attorney, Agent, or Firm*—Becker & Becker, Inc.

[57] ABSTRACT

An enclosure frame that is to be placed in a wall opening for a door or the like. The frame comprises a liner that is disposed in the wall opening, and at least one casting that is disposed on an edge of the liner, extends at right angles to the latter, and is also disposed on a wall surface. For mounting an edge strip, that end of the casing remote from the liner is provided with a retaining strip. The latter has a mounting leg that rests on a wide side of the casing and is secured thereto. The retaining strip also has an insertion leg that extends from the casing at right angles to the wide side thereof. The edge strip has an inner side that faces the wall surface and is provided with a longitudinally extending, slot-like recess into which the insertion leg of the retaining strip can be introduced in a self-clamping manner. The edge strip also has a channel for receiving the mounting leg of the retaining strip and for covering the same from sight.

3 Claims, 1 Drawing Sheet

ENCLOSURE FRAME FOR FACING A WALL OPENING

BACKGROUND OF THE INVENTION

The present invention relates to an enclosure frame to cover or face a wall opening for a door, window, or the like.

To the extent that it is known, especially with wooden frames, to provide on a casing, which is disposed on a liner and is comprised of a board, for optical reasons an edge strip that can have any desired profile and that borders the casing in a wraparound manner, it is customary to glue or nail the edge strip to the casing, with the nail holes being puttied. The edge strips are accordingly securely connected to the casing of the frame. A subsequent removal of the edge strips is impossible, or at least very difficult, and involves the danger of damaging or destroying the edge strips. If a residence, office, or other dwelling is to be remodeled, for example the walls are to be repainted or new wallpaper or other type of wall covering is to be installed, the outer edges of the frames must be covered in order to keep them from getting damaged or dirty.

It is an object of the present invention to embody an enclosure frame that has an edge strip on the casing in such a way that the edge strip can be removed at any time without difficulty, and can be reattached after a wall has been redecorated, so that in this way the wall can be repainted or provided with new wallpaper all the way to below the edge strip. It is a further object of the present invention that it be possible to attach the edge strip to an already installed door frame at a later stage, with simple means and without difficulty, as a removable wall covering strip, or as a border that alters the appearance of the frame.

BRIEF DESCRIPTION OF THE DRAWING

These and other objects and advantages of the present invention will appear more clearly from the following specification in conjunction with the accompanying schematic drawing, in which.

SUMMARY OF THE INVENTION

The enclosure frame of the present invention comprises: a liner that is disposed in the wall opening; at least one casing that is disposed on the edge of the liner, extends at right angles to the latter, and is also disposed on a surface of a wall, with the casing having a wide side that is parallel to the wall surface, and also having a side face that extends perpendicular to the wide side and to the wall surface, and is disposed on an end of the casing that is remote from the liner; a retaining strip that is disposed on the remote end of the casing, with the retaining strip having a mounting leg that rests on the wide side of the casing and is secured thereto, and with the retaining strip also having an insertion leg that is connected to the mounting leg and extends from the casing at right angles to the wide side thereof; and an edge strip that is disposed on the remote end of the casing, with the edge strip having a first portion that is disposed on the wide side of the casing, and a second portion that extends to the wall surface and is spaced from the side face of the casing, and with the edge strip having an inner side that is provided with a longitudinally extending, slot-like recess into which the insertion leg of the retaining strip can be introduced in a self-clamping manner; the edge strip is furthermore provided with a channel for receiving the mounting leg of the retaining strip and for covering this mounting leg from sight.

Further specific features of the present invention will be described in detail subsequently.

DESCRIPTION OF PREFERRED EMBODIMENTS

Figure 1:
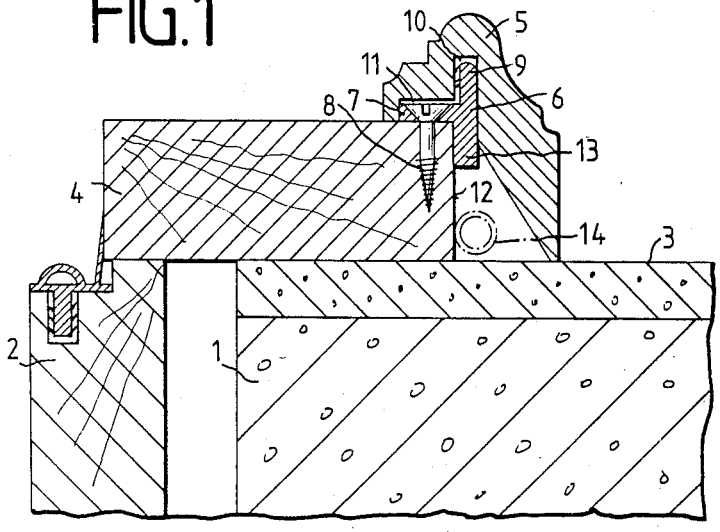
FIG. 1 is a cross-sectional view through first exemplary embodiment of present invention.

Referring now to the drawing in detail, the wooden frame illustrated in FIG. 1 comprises a liner 2, which is disposed in the opening of a wall 1, and at least one casing 4, which is disposed at right angles on the edge of the liner 2, and is disposed on the surface or covering 3 of the wall 1. A wooden edge strip 5 is disposed along that edge of the casing 4 that is remote from the liner 2. In order to establish a detachable connection of the edge strip 5 with the casing 4, a retaining strip 6 is first mounted on the casing 4. A mounting leg 7 rests upon the wide side of the casing 4, and is secured thereto via screws or nails 8. It is not necessary for the securement of the retaining strip 6 that the casing 4 be made of wood. For example, the retaining strip 6 can also be secured with so-called self-tapping or sheet metal screws to a casing that, for example, is a hollow profiled member of metal. The retaining strip 6 is furthermore provided with an insertion leg 9 that extends from the casing 4 at right angles to the wide side of the casing 4 and at right angles to the surface 3 of the wall 1. On the inside, the edge strip 5 is provided with a longitudinally extending, slot-like recess 10 via which the edge strip 5 can be placed upon the insertion leg 9 of the retaining strip 6, at right angles to the wall surface 3, in a self-clamping or a wedging manner. The retaining strip 6 can, for example, be made of a light metal; in order to increase the retaining force of the edge strip 5 on the insertion leg 9, one or both sides of the latter can be provided with a corrugation or the like. The retaining strip 6 can also be made of plastic, and in particular can have a hard core and a soft surface in order to increase the clamping of the insertion leg 9 in the slot-like recess 10. That inner side of the edge strip 5 that faces the casing 4 is provided with a channel 11 in which that part of the retaining strip 6 that does not extend into the slot-like recess 10 of the strip 5, in other words the mounting leg 7, fits with enough space that after the edge strip 5 has been placed upon the retaining strip 6, the strip 5 can rest fully on the wide side of the casing 4, and can also rest snugly against the wall surface 3. That portion of the edge strip 5 that extends to the wall surface 3 can be shortened, for example by being planed off, and can thus be adapted to the thickness of the casing 4 in such a way that when the edge strip 5 rests fully upon the wide side of the casing 4, the adapted portion of the edge strip 5 extends to the wall surface 3 in a manner that is as free of gaps and overlaps as possible. Pursuant to a particularly advantageous feature of the present invention, the retaining strip 6 is furthermore provided with an abutment leg 13 that rests against the side face 12 of the casing 4. The abutment leg 13 facilitates an accurate securing of the retaining strip 6 upon the wide side of the casing 4. The retaining strip 6 could also be secured to the casing 4 via this abutment leg 13 by using screws or nails that extend parallel to the wall surface 3. The mounting leg 9 could in this case still be advantageously provided in order to support the retaining strip 6 upon the casing 4 in the insertion direction for the edge strip 5. Of course, where a frame, such as a door frame, is disposed next to an angled wall, it is impossible, or at least very difficult, to subsequently secure the retaining strip 6 to the side face 12 of the casing 4 with screws or nails that extend parallel to the wall surface 3. Securing the retaining strip 6 via the mounting leg 7 to the wide side of the casing 4 by means of screws or nails that extend perpendicular to the wall surface 3 has the advantage that this can always be accomplished easily and without obstruction from an angled wall or the like. Pursuant to a further specific embodiment of the present invention, that portion of the edge strip 5 that extends to the wall surface 3 can be spaced from the side face 12 of the casing 4 in order in this manner to form a hollow space that is closed off by the edge strip 5, and in which it is possible to place, for example, a telephone line or bell wire that is to extend about the door frame, as it is frequently necessary to do.

The ends of the retaining strip 6 are advantageously somewhat shorter than the edge strip 5 that is to be placed thereupon. In this way, those ends of the vertical and horizontal edge strip that abut one another in a mitered corner of the frame can yield resiliently in a direction parallel to the wall surface. In this way, if the two edge strips are measured slightly longer than the desired length, they can always fully abut one another, without a gap, in the mitered corner of the frame. Furthermore, the end of the edge strip can also resiliently yield somewhat in a direction perpendicular to the wall surface in order to be able to place a lever or other tool under the edge strip 5 in order to be able to completely remove the latter from the retaining strip 6.

Figure 2:
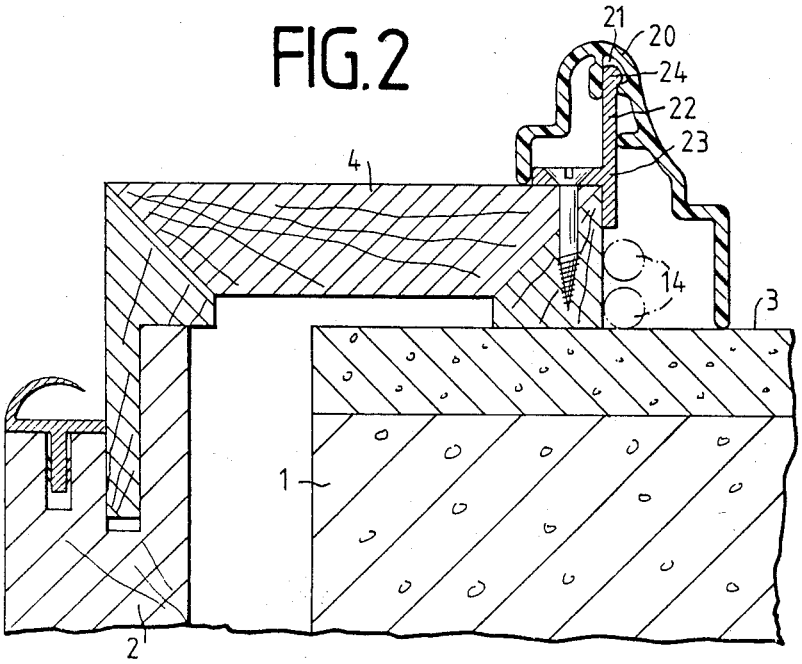
FIG. 2 is a cross-sectional view through a second exemplary embodiment of the present invention.

In the embodiment illustrated in FIG. 2, the edge strip 2 comprises a hollow profiled member that is made of plastic or light metal, and that can, for example, be manufactured by an extrusion process. The slot-like recess 21 that is provided on the inside of the edge strip 20 and is intended for insertion of the insertion leg 22 of the retaining strip 23, is embodied in such a way that the widened head 24 of the insertion leg 22 snaps into the slot-like recess 21, and the edge strip 20 is reliably held against the casing 4 and against the wall surface 3.

It should also be noted that the retaining strip 6 or 23 could also be secured to the casing 4 either exclusively or additionally via an adhesive connection.

The present invention is, of course, in no way restricted to the specific disclosure of the specification and drawing, but also encompasses any modifications within the scope of the appended claims.

What I claim is:

1. An enclosure frame for covering or facing a wall opening for a door, window, or the like, said frame comprising:

a liner that is disposed in said wall opening and has an edge;

at least one casing that is disposed on said edge of said liner, extends at right angles to the latter, and is also disposed on a surface of a wall, with said casing having a wide side that is remote from and parallel to said wall surface, and with said casing also having a side face that extends perpendicular to said wide side and to said wall surface and is disposed on an end of said casing that is remote from said liner;

a retaining strip that is disposed on that end of said casing that is remote from said liner, with said retaining strip having a mounting leg that rests on said wide side of said casing and is secured thereto, and with said retaining strip also having an insertion leg that is connected to said mounting leg and extends from said casing at right angles to said wide side thereof; and an edge strip that is disposed on said end of said casing that is remote from said liner, with said edge strip having a first portion that is disposed on said wide side of said casing, and a second portion that extends to said wall surface in the vicinity of said side face of said casing; said edge strip has an inner side that faces said wall surface and is provided with a longitudinally extending, slot-like recess into which said insertion leg of said retaining strip can be introduced in a self-clamping manner; said edge strip is furthermore provided with a channel for receiving said mounting leg of said retaining strip and for covering said mounting leg from sight.

2. An enclosure frame according to claim 1, in which said retaining strip is additionally provided with an abutment leg that rests against said side face of said casing.

3. An enclosure frame according to claim 1, in which said second portion of said edge strip that extends to said wall surface is spaced from said side face of said casing in such a way as to form a hollow space that can accommodate cables and similar lines.

* * * * *